US005961544A

United States Patent [19]

Goldman et al.

[11] Patent Number: 5,961,544

[45] Date of Patent: Oct. 5, 1999

[54] CONVERTIBLE THERAPEUTIC SPORT SANDAL

[76] Inventors: Robert Arthur Goldman, 8328 Georgetown Pike, McLean, Va. 22102; Edgar Salvador Mendez Chacon, 5603 Independence Cir., Alexandria, Va. 22312-2662

[21] Appl. No.: 09/040,547

[22] Filed: Mar. 18, 1998

[51] Int. Cl.[6] ..... A61F 7/00

[52] U.S. Cl. ..... 607/111; 607/112; 607/114

[58] Field of Search ..... 607/108–112, 114, 607/96

[56] References Cited

PUBLICATIONS

"Massage Your Feet as You Walk" Gel Sale Advertisement.

*Primary Examiner*—Robert L. Nasser

[57] ABSTRACT

A sports sandal with a removable insole inside the body of the sandal, which, when removed, allows a user to install a therapeutic comfort device. The therapeutic device can be frozen or warmed according to the user's preference.

7 Claims, 5 Drawing Sheets

CONVERTIBLE THERAPEUTIC SPORT SANDAL

FIELD OF THE INVENTION

This invention is directed to the field of injury treatment via convenient application of heat or cold packs. More particularly the invention is directed to the field of injury treatment of the feet via heat or cold packs.

BACKGROUND OF THE INVENTION

Minor foot ailments such as sprains, tears and swelling are common conditions suffered by athletes and runners in particular. Often, such conditions are self treated without breaking an athlete's training regime. Common recommendations for self-treatment include the application of heat before activity to warm up the foot tissues, application of ice after activity to reduce swelling, and stretching the tissues both before and after activity to avoid tearing of the foot tissues.

The prior art typifies these various approaches to solving the above problems. For example, Cropley, in U.S. Pat. No. 647,294 teaches a hot water bag into which feet may be inserted. While this invention provides means for thermal therapeutic relief, it requires the user to be immobile.

Marcellus, in U.S. Pat. No. 1,257,086 offers a modification of the above through a hot water boot. The invention disclosed therein provides therapeutic relief and allows the user to be mobile. It does not address treatment of injuries via ice or cold temperature therapy.

Weintraub et al in U.S. Pat. No. 4,005,531 teaches foot coolers containing a removable refrigerant device adapted to provide cool temperature comfort to user's feet. The invention is silent with respect to the treatment of injury, and fails to teach or suggest the use of a hot insole for treatment of injury.

Cherniak in U.S. Pat. No. 4,967,750 teaches a modular orthopedic sandal that is intended to provide rigid orthopedic support for particular regions of the foot, but provides no suggestion that the device is designed for hot/cold therapy.

Golden Age Products advertises gel filled insoles to cushion feet when walking. Again, however, there is no disclosure with respect to hot/cold treatment of foot injuries.

Thus, each of the above teachings fails to address the overall problem of hot and cold treatment of foot injuries. While each addresses either hot or cold treatments, none teach apparatus or footwear adaptable for both. Thus there is a need in the art to provide a convenient means for providing hot and cold treatment of foot injuries. Further there is a need to provide such a therapeutic device that is easily convertible between both types of treatment.

OBJECTS OF THE INVENTION

It is therefore an object of the invention to provide footwear having means for thermal and cold treatment of foot injuries therein.

It is a further object of the invention to provide therapeutic footwear that is multifunctional and permits for convenient conversion between both hot and cold temperature treatments.

It is a further object of the invention to provide footwear having integrally formed removable hot or cold pack for the treatment of foot injuries.

BRIEF DESCRIPTION OF THE DRAWINGS

Other objects, features and advantages will occur to those skilled in the art from the following description of preferred embodiments and the accompanying drawings, in which.

SUMMARY OF THE INVENTION

The invention preferably comprises convertible therapeutic sandal having:

a) a resilient flexible sole having a recess therein;

b) a flexible insole which is shaped to fit into said recess of said flexible insole and which may be reversibly attached into said recess of said flexible sole; and c) a therapeutic insole which is shaped to fit into said recess and which may be reversibly attached into said recess of said flexible sole, said therapeutic insole comprising a flexible container filled with a solution formulated to retain hot or cold temperatures for a period of time. The flexible insole and therapeutic insole may be exchanged for each other into the sole of the sandal.

DETAILED DESCRIPTION OF THE INVENTION

This invention addresses the problem of foot pain, particularly that suffered by athletes such as runners. The invention has the ability to quickly alleviate foot pain with the convenience of enabling a user to retain mobility. A user can choose to heat the gel pack (or "temperature therapy device") prior to running as a warm-up device to avoid foot injury, or use a refrigerated or frozen gel pack to reduce foot swelling and pain after running. Since the gel pack is removable, the user can install the removable insole in lieu of the gel pack when the therapeutic effect has been achieved. Thus the present invention offers solutions to multiple problems not offered by the prior art. That is, it addresses injury relief by way of hot or cold therapy, while possessing the convenience of convertibility from a therapeutic apparatus to standard footwear.

Figure 1:
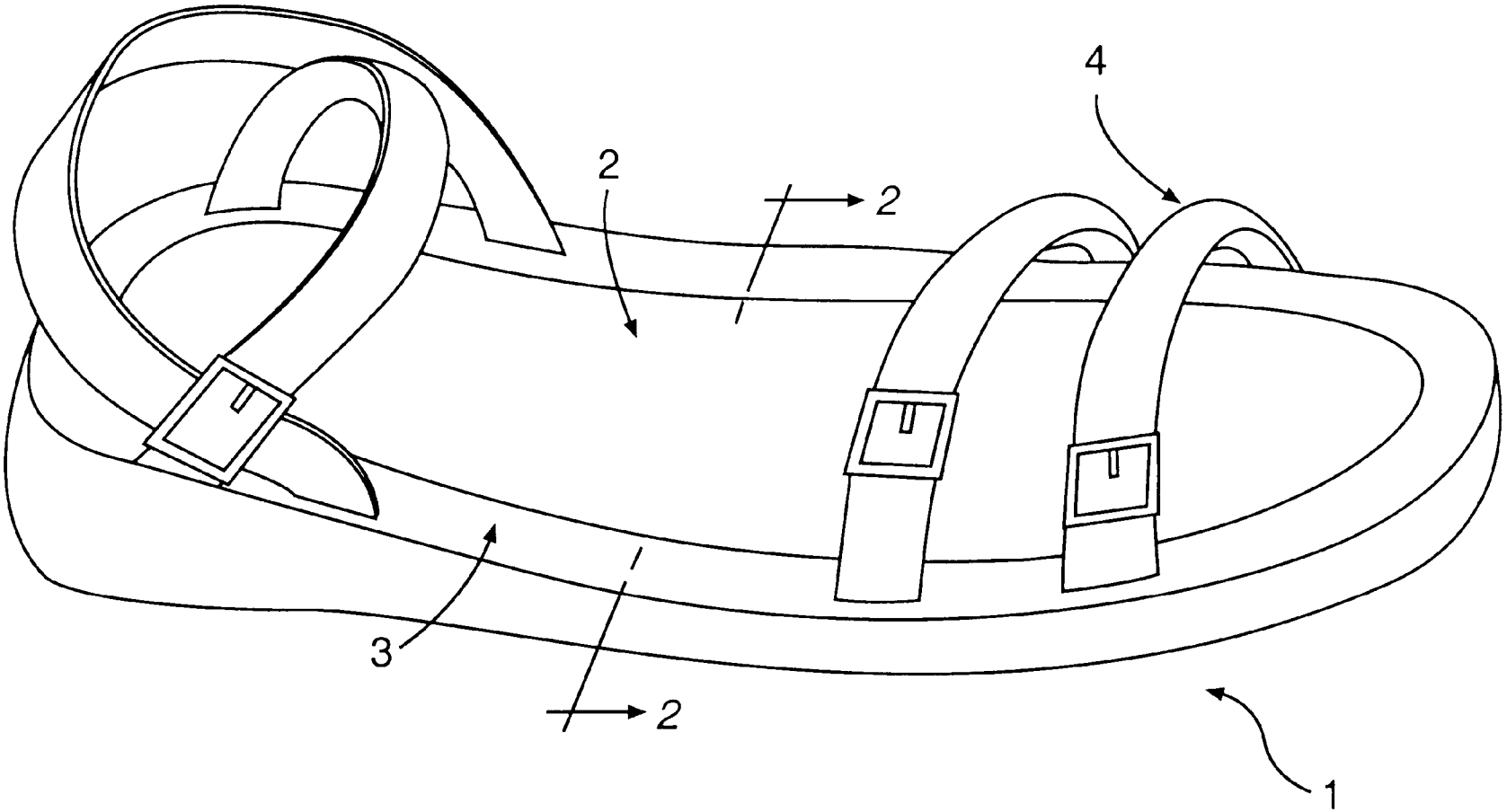
FIG. 1 is a schematic diagram of one embodiment of the invention with a removable insole installed.

FIG. 1 illustrates an overall view of one embodiment of the invention. In this Figure, the therapeutic sandal 1 includes an insole 2 which is releasably attached to sole 3. The sandal 1 may be attached to the users foot via straps 4, which are attached to sole 3. The sole 3 is preferably fabricated of a resilient flexible material such as rubber, plastic or foam as is conventionally used in the manufacture of sandals.

Figure 2:
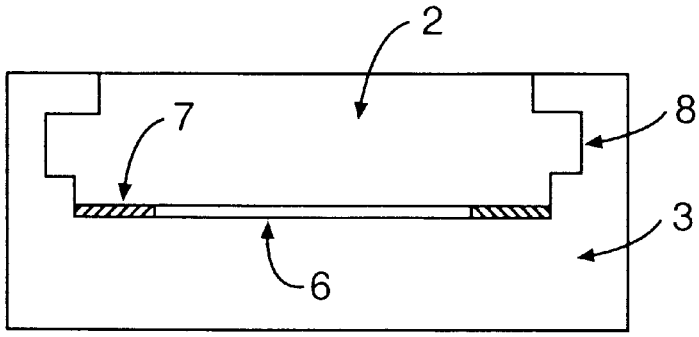
FIG. 2 is a cross section (at A in FIG. 1) of one embodiment of the invention showing the means for securing a removable insole into the recessed sole of a sandal.
Figure 4:
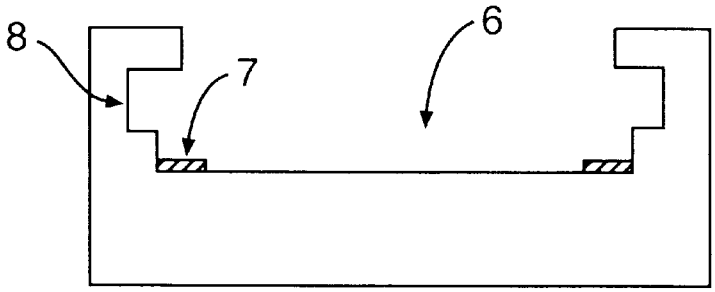
FIG. 4 is a cross section (at B in FIG. 3) of one embodiment of the invention showing the recessed sole of a sandal with the removable insole removed.
Figure 5:
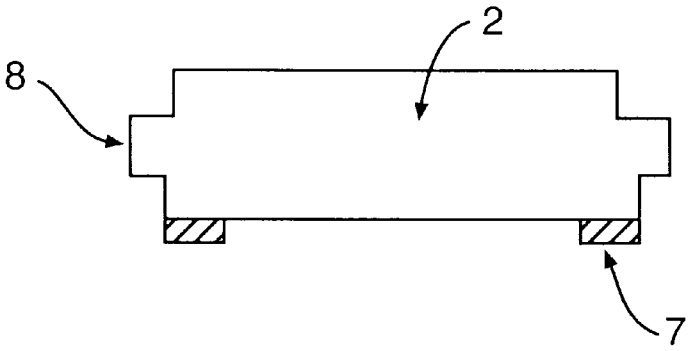
FIG. 5 is a cross section (at A in FIG. 1) of the removable insole as removed from the recessed sole.
Figure 6:
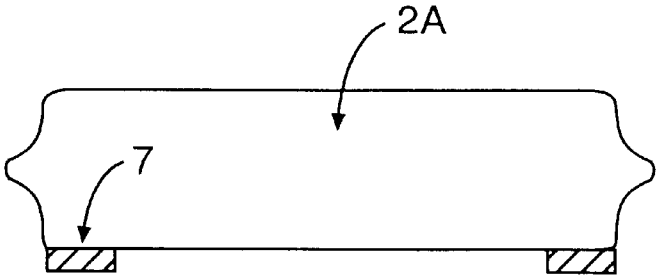
FIG. 6 is a cross section of the removable temperature therapy device which can be inserted into the recessed sole of the sandal.

FIG. 2 illustrates a cross-section along axis A (of FIG. 1). As can be seen, sole 3 contains recess 6 into which a removable insole 2 is placed. The insole 2 has primary fastening means 7 including, but not limited to a hook and loop fastening device (e.g. VELCRO™), a reversible adhesive material and spike in hole or snap arrangements. In addition, the sole may preferably be grooved on the inside edges of recess 6 as indicated at 8, and removable insole 2 may be adapted so as to fit into said groove such that said insole is locked into position.

Removable insole 2 may be made of several types of materials, depending upon the embodiment preferred by the user. Preferably, it is the size and shape of a foot, though it may be smaller depending upon the size of the heated or cold treatment pack to be used. In a preferred embodiment, removable insole 2 is rubber, flexible plastic, foam or cork. The key aspect of the invention is that the removable insole 2 may be replaced with either a hot or cold treatment insole pack (or "temperature therapy device") 2A that fits into recess 6 in the same manner as the non-treatment insole 2.

The insole treatment pack 2A preferably has some liquid anti-freeze solution for absorbing a considerable amount of heat or cold, which is retained for a period of time. The anti-freeze solution in the packets in these devices will provide an unfrozen slush at a low temperature. After cooling or heating the device is then fitted into recess 6 to treat the injured area. Such therapeutic packs are disclosed in, for example U.S. Pat. No. 3,463,161 which discloses unique compositions which remain permanently plastic at low or high temperatures. Various other types of devices including compositions which retain temperature are known, and have been previously proposed by the devices disclosed in U.S. Pat. Nos. 750,104; 3,780,537; 3,822,705; 3,885,403; 3,871,376; 4,055,188; 4,092,982; and 4,204,543 which all describe devices for applying hot or cold treatment to various parts of the body of humans and animals. In some cases these patents describe particular materials which maintain a gel-like consistency over a wide temperature range. One such material is commonly known by the trademark name of "Blue-Ice."

Materials for use in these hot and cold treatment devices are disclosed in U.S. Pat. Nos. 2,803,115; and 3,545,230 incorporated herein by reference. These devices disclose either a slurry comprised of a mixture of starch, water and borax; or a insoluble hydrophilic gel which when frozen can be molded into various geometric shapes which can retain that particular configuration as long as the material remains stiff As indicated above, for the purposes of this invention, therapeutic packs are designed such that they are the same or substantially the same shape as the non-therapeutic insole, and fit into recess 6.

Figure 3:
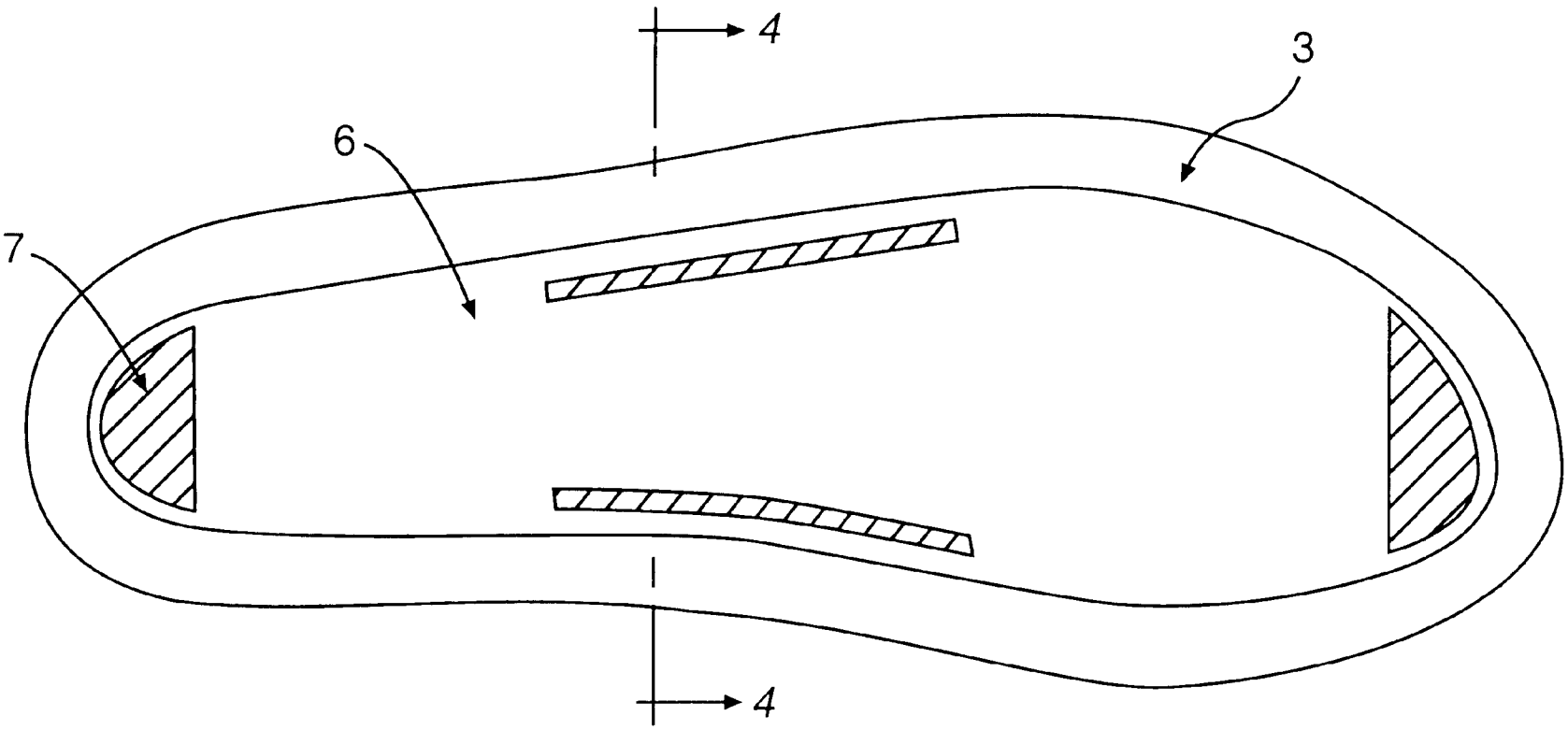
FIG. 3 is top view of a recessed sole of a sandal in which the removable insole has been removed to expose the recessed portion of the sole and the attachment means.
Figure 7:
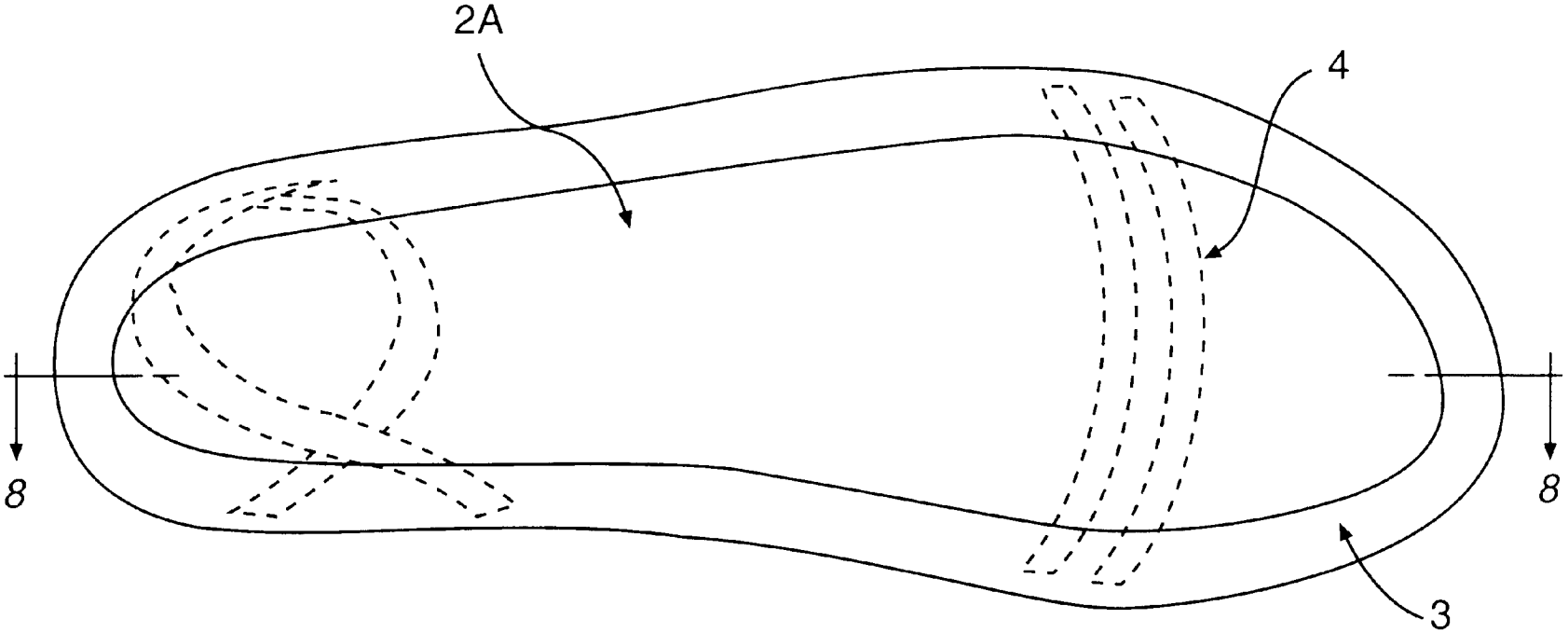
FIG. 7 is a plan view of one embodiment of the invention with a removable temperature therapy device installed.
Figure 8:
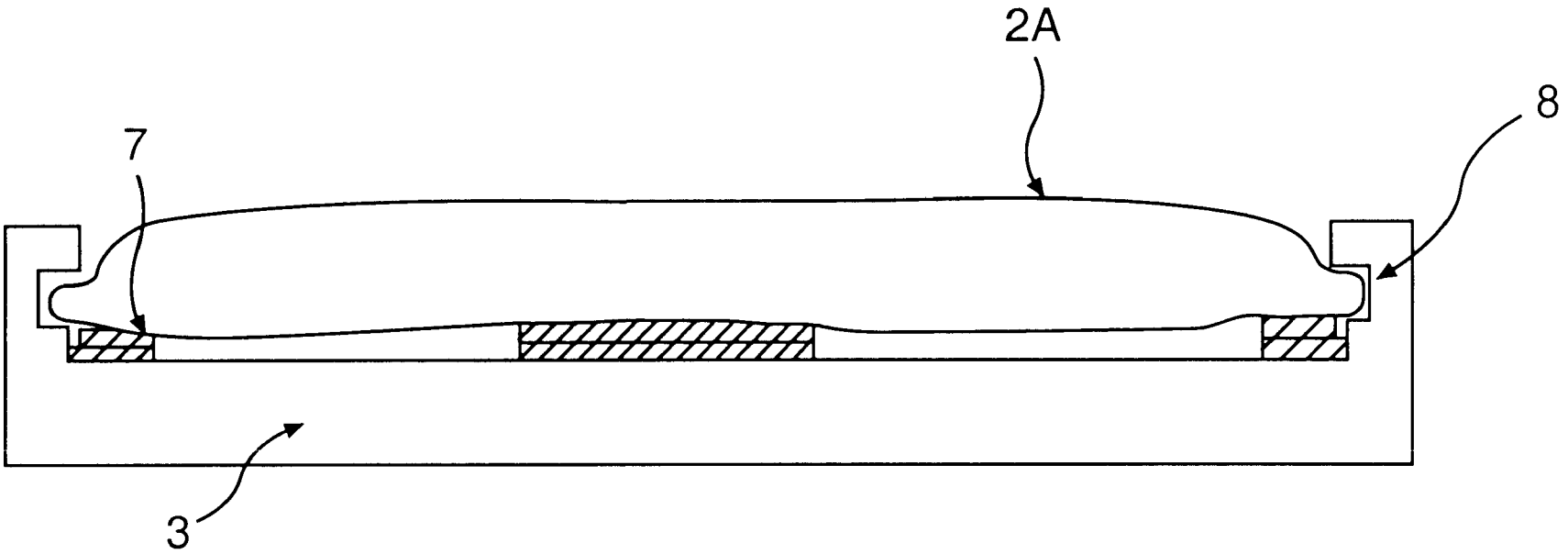
FIG. 8 is a longitudinal cross section (at C in FIG. 7) of the subject of FIG. 7.

FIG. 3 shows a view of a preferred embodiment as viewed from the top of the sandal, looking down. In this view, the sandal has no insole. Thus, this figure illustrates a preferred arrangement of fastening means 7 in the recess 6 of the sandal.

As can be seen from the above description, the inventive convertible therapeutic sandal differs from prior art therapy devices. For example, the invention differs from Marcellus in that the boot disclosed therein is not convertible from a therapeutic device to standard footwear. Further, Marcellus does not teach the use of a gel pack feature which can be frozen or heated separately from the footwear.

The invention differs from Weintraub in that the footwear disclosed therein is not designed to provide for a system wherein multiple insoles are interchangeable for a particular desired purpose according to a user's needs. In particular, Weintraub makes no mention of the use of thermal insoles.

It should be recognized that while the preferred embodiment of the invention is a sandal, the inventive concept may also be applied to other types of footwear, such as sneakers. In particular, the sole of such footwear would be recessed such that the removable therapeutic pack may be inserted and removed without difficulty.

Specific features of the invention are shown in one or more of the drawings for convenience only, as such features may be combined with other features in accordance with the invention. Alternative embodiments will be recognized by those skilled in the art and are intended to be included within the scope of the claims.

What is claimed is:

1. Convertible therapeutic footwear kit comprising:

a) a resilient flexible sole having a recess therein;

b) a flexible insole which is shaped to fit into said recess of said flexible insole and which may be reversibly attached into said recess of said flexible sole;

c) a therapeutic insole which is shaped to fit into said recess and which may be reversibly attached into said recess of said flexible sole, said therapeutic insole comprising a flexible container filled with a solution formulated to retain hot or cold temperatures for a period of time;

wherein said flexible insole and said therapeutic insole may be exchanged for each other into said flexible sole.

2. The footwear kit of claim 1, wherein said footwear comprises a sandal.

3. The footwear kit of claim 2, wherein the sandal further comprises straps attached to said sole and being adapted for removably retaining said sandal on a user's foot.

4. The footwear kit of claim 1, wherein said sole further comprises releasable attachment means within said recess such that either of said insoles described in "b" or "c" may be attached into said sole.

5. The footwear kit of claim 4, wherein said releasable attachment means are selected from either releasable adhesive or hook and loop material or both.

6. The footwear kit of claim 1, wherein either of said insoles further comprise releasable attachment means wherein either of said insoles may be attached into said recess in said sole.

7. The footwear kit of claim 5, wherein said releasable attachment means are selected from either releasable adhesive or hook and loop material or both.

* * * * *